United States Patent [19]

Bathellier et al.

[11] 4,356,153

[45] Oct. 26, 1982

[54] URANIUM RECOVERY PROCESS

[75] Inventors: André Bathellier, Sceaux; Claude Ginisty, Villeneuve le Roi, both of France

[73] Assignee: Commissariat a l'Energie Atomique, Paris, France

[21] Appl. No.: 94,890

[22] Filed: Nov. 16, 1979

[30] Foreign Application Priority Data

Nov. 28, 1978 [FR] France ..... 78 33543
Jun. 15, 1979 [FR] France ..... 79 15397

[51] Int. Cl.[3] ..... C01G 43/00
[52] U.S. Cl. ..... 423/10; 423/15
[58] Field of Search ..... 423/10, 15

[56] References Cited

U.S. PATENT DOCUMENTS

| | | | |
|---|---|---|---|
| 2,859,094 | 11/1958 | Schmitt et al. | 423/10 |
| 2,902,454 | 9/1959 | Moore | 423/10 X |
| 3,230,036 | 1/1966 | Kappelmann et al. | 423/10 |
| 3,711,591 | 1/1973 | Hurst et al. | 423/10 |
| 4,012,480 | 3/1977 | Delvalle | 423/10 |
| 4,243,637 | 1/1981 | Bradford et al. | 423/10 |

FOREIGN PATENT DOCUMENTS 2346361 10/1977 France .

*Primary Examiner*—Edward A. Miller

[57] ABSTRACT

Process for the recovery of the uranium present in a phosphoric acid solution by bringing the said solution into contact with an organic solvent suitable for extracting the uranium, wherein the organic solvent comprises a system of extractants constituted by an acid organophosphorus compound and by a neutral phosphine oxide of formula:

(I)

in which the radicals $R_1$, $R_2$ and $R_3$ are identical or different alkyl, aryl or alkoxyalkyl radicals, at least one of the radicals $R_1$, $R_2$ and $R_3$ being an alkoxyalkyl radical.

12 Claims, 3 Drawing Figures

URANIUM RECOVERY PROCESS

BACKGROUND OF THE INVENTION

The present invention relates to a process for the recovery of the uranium present in phosphoric acid solutions and particularly in phosphoric acid solutions obtained from phosphatic ores.

It is known that phosphatic ores contain by no means negligible uranium quantities which, during the action of a sulphuric solution on these ores, pass into the phosphoric acid solution obtained.

The presently known processes for ensuring the recovery of the uranium present in phosphoric acid obtained from phosphatic ores generally involve an extraction by means of suitable organic solvents. However, the hitherto used solvents have proved to be relatively ineffective due to the large quantities of phosphoric acid solution to be treated, the high phosphoric acid concentration thereof and the simultaneous presence of iron in these solutions.

BRIEF SUMMARY OF THE INVENTION

The present invention relates to a process for the recovery of the uranium present in a phosphoric acid solution, which makes it possible to obtain good uranium extraction levels, even when the phosphoric acid solution concentration is relatively high, for example of the order of 8 M.

The invention therefore relates to a process for the recovery of the uranium present in a phosphoric acid solution by bringing the said solution into contact with an organic solvent suitable for extracting the uranium, wherein the organic solvent comprises a system of extractants constituted by an acid organophosphorus compound and by a neutral phosphine oxide of formula:

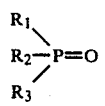

(I)

in which the radicals $R_1$, $R_2$ and $R_3$ are identical or different alkyl, aryl or alkoxyalkyl radicals, at least one of the radicals $R_1$, $R_2$ and $R_3$ being an alkoxyalkyl radical.

The process as defined hereinbefore has the advantage of leading to better uranium extraction rates due to the nature of the system of extractants. Thus, such a system makes it possible to obtain good uranium partition coefficients between the organic phase and the aqueous phase. In addition, it can be used as higher concentrations than in the presently known systems, particularly due to the very good solubility of the neutral phosphine oxide in the inert diluents conventionally used for this type of extraction.

According to the invention the acid organophosphorus compound is advantageously a dialkyl phosphoric acid of formula:

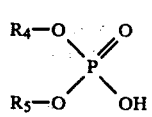

(II)

in which $R_4$ and $R_5$ are identical or different alkyl radicals and preferably branched alkyl radicals having at least eight carbon atoms. An example of the dialkyl phosphoric acid which can be used is di-2-ethyl-hexyl phosphoric acid.

According to the invention it is also possible to use as the acid organophosphorus compound a phosphonic acid of formula:

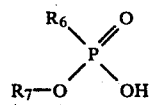

(III)

in which $R_6$ and $R_7$ are identical or different alkyl or aryl radicals. Examples of phosphonic acids which can be used are the ethyl-2-hexyl monoester of phenyl phosphonic acid, the n-octyl monoester of phenyl phosphonic acid and the octyl-phenyl monoester of phenyl phosphonic acid.

According to the invention the neutral phosphine oxide according to formula (I) is advantageously chosen from among the phosphine oxides for which at least one of the $R_1$, $R_2$ or $R_3$ radicals is an alkoxymethyl radical having four to twelve carbon atoms. Preferably when the phosphine oxide has alkyl radicals, the latter are linear radicals.

Examples of the neutral phosphine oxide which can be used are diphenyl-octoxymethyl phosphine oxide, diisobutyl-octoxymethyl phosphine oxide, di-n-butyl-octoxymethyl phosphine oxide, di-n-pentyl-octoxymethyl phosphine oxide and di-n-hexyl-octoxymethyl phosphine oxide. According to the process of the invention preference is given to the use of di-n-hexyl-octoxymethyl phosphine oxide.

In the system of extractants used in the process of the invention the concentrations of the acid organophosphorus compound and the neutral phosphine oxide are advantageously such that the molar ratio of the acid organophosphorus compound to the neutral phosphine oxide is between 4 and 5.

For the purpose of performing the process of the invention the above-mentioned system of extractants is advantageously diluted in an inert solvent constituted, for example, by a saturated hydrocarbon having at least eight carbon atoms, such as dodecane.

In the organic solvent the total concentration of extractants advantageously exceed 0.6 M in order to obtain good uranium extraction levels.

It is pointed out that the process of the invention can be performed in any conventional extraction apparatus, such as mixer-settler sets, pulsed columns, centrifugal extractors, etc.

According to the invention the uranium extracted in the organic solvent can then be reextracted by bringing the said solvent into contact with an aqueous phosphoric acid solution optionally containing a reducing agent in such a way as to reduce the uranium VI extracted in the organic solvent into uranium IV in order to facilitate its reextraction.

Although this reextraction procedure makes it possible to obtain a satisfactory uranium recovery it has the disadvantage of necessitating the addition of a reducing agent and the use of a concentrated phosphoric acid solution, making a supplementary purification cycle necessary.

According to the invention the uranium reextraction is preferably performed in a reextraction apparatus having at least three stages and for the purpose of this reextraction the organic solvent containing the uranium is circulated in the said stages by introducing it into the first stage. In the said stages an aqueous ammonium carbonate solution is circulated in countercurrent with the said organic solvent by introducing it into the final stage in a quantity such that it represents 50 to 80% of the stoichiometric quantity necessary for neutralizing the acid organophosphorus compound and for transforming the uranium present in the organic solvent into uranyl ammonium tricarbonate. Ammonia is added in the form of gas or aqueous solution to the ammonium carbonate solution circulating in the first stage in order to maintain the pH of said first stage at a value between 8 and 8.5.

The ammonia organic solvent leaving the final reextraction stage is preferably purified by reacting it with an acid to eliminate the ammonium in the form of ammonium salt and the thus purified organic solvent is reused for carrying out the uranium extraction.

Advantageously the acid is chosen from the group containing sulphuric acid, hydrochloric acid and phosphoric acid.

Also is preferred manner the ammonia organic solvent leaving the final reextraction stage is purified by reacting it with the phosphoric acid recovered at the end of uranium extraction.

This preferred uranium reextraction procedure makes it possible to obtain at the end of reextraction an aqueous uranium solution from which it is possible to easily recover the uranium without any supplementary purification cycle, either in the form of an oxide, or in the form of an alkaline or earth alkaline uranate, with an overall uranium recovery yield in excess of 90%.

Moreover it leads to the formation of reusable products. Thus, the organic solvent which has been purified by treatment with the phosphoric acid can be reused for the extraction of uranium and the ammonium phosphate obtained during the purification treatment of the organic solvent is a product which can be commercialized or recycled, for example in a fertiliser unit.

According to the invention uranium reextraction is preferably performed in three stages. In this case the organic solvent containing the uranium is circulated from the first to the third stage and into the third stage is introduced an aqueous ammonium carbonate solution or a mixture of carbon dioxide gas and ammonia previously dissolved in water in the form of carbonate representing 50 to 80% of the stoichiometric quantity necessary for neutralizing the acid organophosphorus compound of the organic solvent and for transforming the uranium into uranyl ammonium tricarbonate. This solution circulates from the third stage to the first stage and prior to its entry in the first stage ammonia in the form of a gas or an aqueous solution is added thereto, the added quantity being such that the pH of the first stage is maintained at a value between 8 and 8.5.

Thus, for pH values below 8 the uranium reextraction level decreases and for pH values above 8.5 the quantity of ammonia introduced leads to the formation of emulsions and does not lead to an improvement in the uranium reextraction level.

Ammonia is preferably added in the form of an aqueous solution having a molar ammonia concentration of 5 M to 7.5 M.

In these stages the uranium-charged organic solvent, which also contains iron on contact with the ammonia is gradually transformed into a hydrated ammonium salt and the aqueous phase which circulates in countercurrent is enriched with uranium and iron. The ammonium carbonate forms with the uranium uranyl ammonium tricarbonate which remains in solution and the iron is transformed into ferric hydroxide, which is precipitated and can be separated by settling from the aqueous phase.

On leaving the third stage the organic ammonia solvent is preferably purified by treatment with an acid, such as sulphuric acid, hydrochloric acid, or phosphoric acid, making it possible to recover an organic phase no longer containing ammonium ions and an aqueous phase containing an ammonium salt. A phosphoric acid fraction recovered at the end of the uranium extraction stage is preferably used for this treatment.

BRIEF DESCRIPTION OF THE DRAWINGS

Other features and advantages of the invention can be gathered from the following description, which is given in an illustrative and non-limitative form and with reference to the attached drawings, wherein shown.

DETAILED DESCRIPTION OF THE PREFERRED EMBODIMENTS

Figure 1:
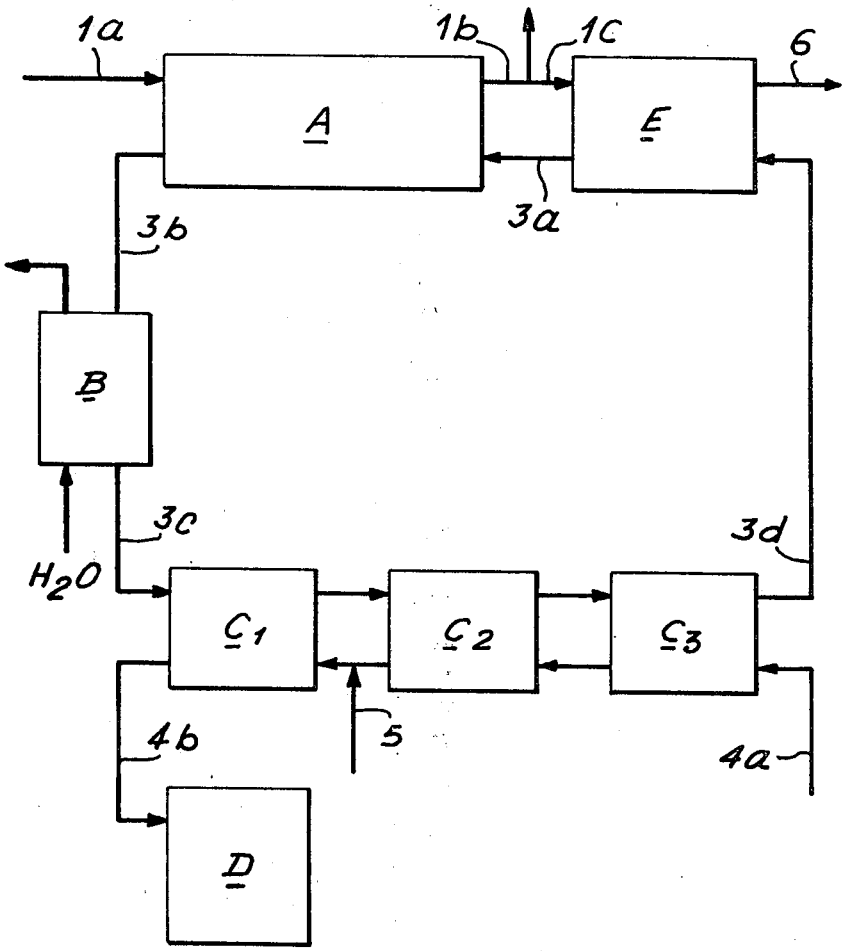
FIG. 1 a diagrammatic representation of the various stages of the process of the invention.

In FIG. 1 the reference A designates the uranium extraction unit, reference B represents a unit for washing the organic solvent leaving the extraction unit, references $C_1$, $C_2$ and $C_3$ designate the three reextraction stages, reference D illustrates the uranium separation unit and reference E designates the organic solvent purification unit.

Phosphoric acid from a production unit and containing 0.05 to 0.20 g/l of uranium, 2 to 5 g/l of iron and a maximum of 2 g/l of calcium is introduced by line 1a into extraction unit A. Said acid has previously undergone an oxidation treatment to bring all the uranium into hexavalent form, whilst the iron is brought into the trivalent state.

In extraction unit A the phosphoric acid is brought into countercurrent contact with an organic solvent introduced by line 3a. This organic solvent has a system of extractants constituted by an acid organophosphorus compound and by a neutral phosphine oxide in accordance with formula (I) and it is advantageously constituted by a mixture of di-2-ethyl-hexyl phosphoric acid (DEHP) and di-n-hexyl-octoxymethyl phosphine oxide (POX 11) diluted in dodecane, the concentration of di-2-ethyl-hexyl-phosphoric acid being 0.1 to 1 M/l and that of the di-n-hexyl-octoxymethyl phosphine oxide 0.025 to 0.25 M/l.

The extraction is performed with a volume ratio of the phosphoric acid to the organic solvent of preferably 1 to 10 and a temperature between 25° and 65° C., preferably close to 40° C.

On leaving the extraction unit A the phosphoric acid substantially no longer containing uranium is discharged by line 1b and the uranium-charged organic solvent, which is also slightly contaminated with metallic ions and in particular ferric ions is discharged by line 3*b*.

This organic solvent then passes into the washing unit B where it is washed with water in order to essentially eliminate the phosphoric ions entrained by the solvent.

On leaving the washing unit it is introduced by line 3*c* into the first reextraction stage $C_1$ and then circulates in the following stages $C_2$ and $C_3$.

In stages $C_2$ and $C_3$ it is brought into countercurrent contact with an ammonium carbonate solution introduced into the final stage $C_3$ by line 4*a* and in stage $C_1$ it is brought into countercurrent contact with the carbonate solution from stage $C_2$ and with ammonia in the form of gaseous ammonia or an ammonia solution injected by line 5 into the carbonate solution which penetrates the final stage $C_1$.

According to the invention the ammoniacal or ammonia flow is regulated by means of a valve controlled by a pH-meter in such a way as to maintain the pH value of the first stage $C_1$ at a value between 8 and 8.5. In the same way the flow of ammonium carbonate solution introduced into the last stage $C_3$ by line 4*a* is regulated in such a way that it corresponds to 50 to 80% of the stoichiometric quantity necessary for neutralizing on the one hand the di-2-ethyl-hexyl phosphoric acid and transforming on the other hand the uranium into uranyl ammonium tricarbonate.

During the reextraction the organic solvent charged with uranium and iron, which is initially in contact with the ammonia gradually transforms into a hydrated ammonium salt and the aqueous phase travelling in countercurrent is enriched with uranium and iron, whilst the ammonium carbonate reacts with the uranium to form uranyl ammonium tricarbonate which remains in solution and the iron is precipitated in hydroxide form. The aqueous phase containing the uranyl ammonium tricarbonate leaves the first reextraction stage $C_1$ by line 4*b* and is then directed towards the uranium separation unit D.

It is pointed out that the uranium can be separated from this solution either in oxide form or in sodium uranate form.

To obtain uranium in the form of uranium trioxide the uranyl ammonium tricarbonate solution is subjected to air bubbling in a reactor at a temperature between 90° and 100° C. for about six hours and the precipitate is then filtered and washed with water. After drying at 120° C. and roasting at approximately 400° C. uranium trioxide is obtained. To obtain uranium in the form of sodium uranate and uranyl ammonium tricarbonate solution which has previously been degassed by air bubbling at about 90° C. to eliminate the carbon dioxide gas and ammonia is neutralized by means of soda at approximately 80° C. and then the uranium is precipitated by adding sodium hydroxide to the solution, whilst working at a temperature of 80° C. for one hour. After filtering and washing with water at 50° C. the sodium uranate is collected and this can subsequently be transformed into ammonium diuranate or into uranium trioxide.

On leaving the third reextraction stage $C_3$ the uranium-removed organic solvent is discharged by line 3*d* and is passed to the purification stage E in which it is treated by means of phosphoric acid introduced via line 1*c*. This phosphoric acid constitutes a fraction of the phosphoric acid leaving extraction stage A by pipe 1*b*. By bringing the organic solvent into contact with the phosphoric acid the ammonium salt of the extraction agent is decomposed, leading to the formation of ammonium phosphate which is discharged by line 6 and to the obtention of the purified organic solvent, which can be recycled by line 3*a* for reuse in extraction stage A.

It is pointed out that the ammonium phosphate recovered in this way can be directly commercially used or can be used in fertiliser production units.

The following examples serve to illustrate the results obtained by performing the process of the invention.

EXAMPLE 1

This example relates to the recovery of uranium from a 6 M phosphoric acid solution containing 1 g/liter of uranium and 1 g/liter of iron.

In this example the organic solvent used is a mixture of di-2-ethyl-hexyl phosphoric acid (DEHP) and di-n-hexyl-octoxymethyl phosphine oxide (POX 11) diluted in dodecane with a concentration of 0.5 M per liter for DEHP and variable concentrations for POX 11.

The extraction is carried out by contacting for about 15 mn an aqueous phosphoric acid solution with an organic solvent volume, whilst mechanically stirring the two phases. The two phases are then separated by centrifuging, followed by sampling and analysis in order to determine their uranium concentration.

It is pointed out that the uranium concentrations are measured by potentiometry (oxidoreduction with potassium dichromate) or by colorimetry (with dibenzoyl methane).

The distribution or partition coefficient D is then determined and this is equal to the ratio of the uranium concentration of the organic phase to the uranium concentration of the aqueous phase.

The results obtained are given in Table I and are shown in FIG. 1, which illustrates the variation of the uranium partition coefficient D as a function of the POX11 content of the organic solvent, the latter containing in each case 0.5 M per liter of DEHP.

TABLE I

| di-2-ethyl-hexyl phosphoric acid | di-n-hexyl-octoxymethyl phosphine oxide | D |
|---|---|---|
| 0.5 $M.l^{-1}$ | 0.05 $M.l^{-1}$ | 2.24 |
| 0.5 | 0.1 | 6.74 |
| 0.5 | 0.150 | 3.45 |
| 0.5 | 0.2 | 3.24 |

This shows that the uranium partition coefficient D has a maximum when the organic solvent contains 0.5 M per liter of DEHP and 0.1 M per liter of POX11. It is also apparent that good results are obtained when the molar ratio of DEHP to POX11 is between 3 and 4.

EXAMPLE 2

This example relates to the extraction of uranium from a 6 M phosphoric acid solution also containing 1 g per liter of uranium and 1 g per liter of iron.

In this example uranium extraction is carried out under the same conditions as in Example 1 and once again the organic solvent used is a mixture of DEHP and POX11 diluted in dodecane.

In this example the total concentration of extractants in the organic solvent is varied by adopting in each case a molar ratio of DEHP to POX11 equal to 5.

After each extraction the uranium partition coefficient D is determined, as is that of the iron after measuring the concentrations in uranium (VI) and iron (III) of the aqueous and organic phases.

Figure 2:
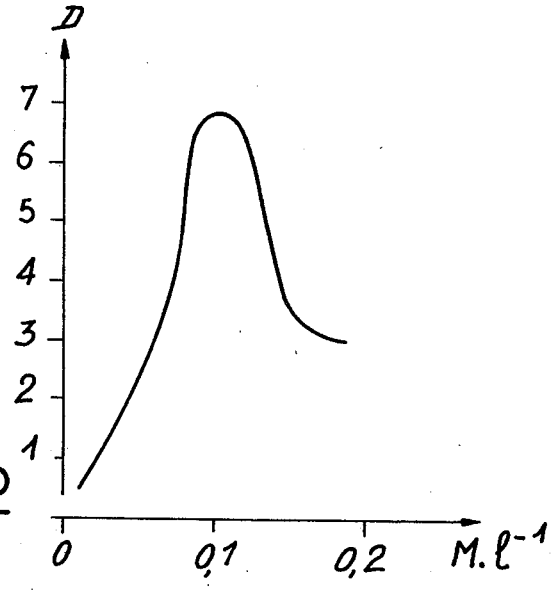
FIG. 2 a diagram showing the variations in the distribution or partition coefficient D of the uranium as a function of the neutral extractant concentration in the mixture used for extraction purposes.
Figure 3:
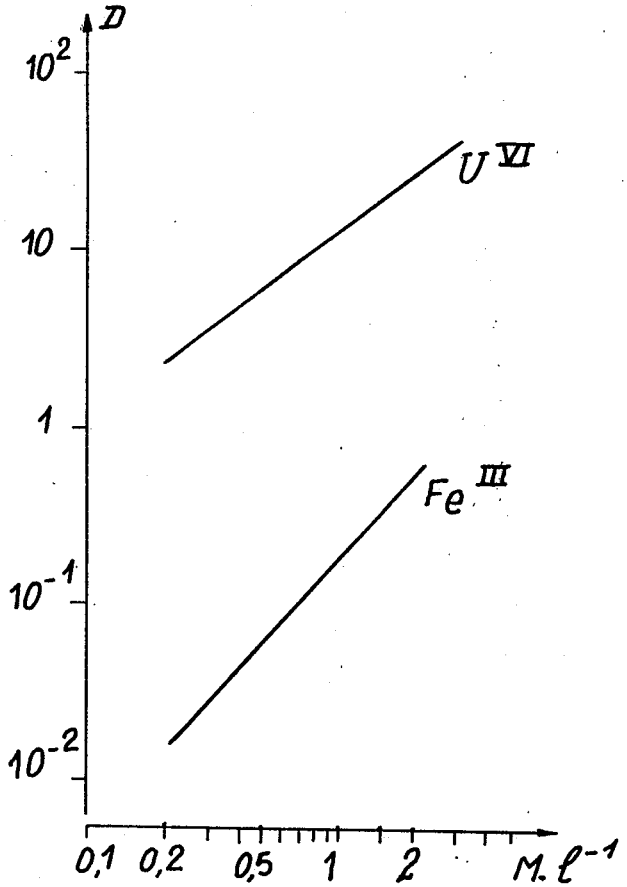
FIG. 3 a diagram showing the variations in the partition coefficient D of uranium and iron as a function of the total concentration of extractants of the organic solvent used.

The results obtained are given in Table II and shown in FIG. 2 which illustrates the variations of the partition coefficients D of the uranium and the iron as a function of the total concentration of extractants.

TABLE II

| DEHP | POX11 | $D(U^{VI})$ | $D(Fe^{III})$ |
|---|---|---|---|
| 0.25 $M.1^{-1}$ | 0.05 $M.1^{-1}$ | 3.24 | 0.027 |
| 0.50 | 0.10 | 6.74 | 0.06 |
| 1.00 | 0.20 | 13.9 | 0.21 |
| 1.50 | 0.30 | 21.1 | 0.32 |

I can be seen that the partition coefficient regularly increases with the content of extractants and that it increases more rapidly for iron than for uranium.

uranium and 1 g per liter of iron, using as the organic solvent different mixtures of acid organophosphorus compound and neutral phosphine oxide diluted in dodecane.

In each case the extraction is carried out by bringing into contact one volume of the aqueous solution with one volume of the organic solvent for a period of about 15 mn and the partition coefficients D of the uranium (VI) and the iron (III) are then determined. The results obtained are given in Table IV.

It is pointed out that in all the above examples it is possible to recover the uranium extracted in the organic solvent by bringing the latter into contact with a phosphoric acid solution preferably having a phosphoric acid concentration above 10 M and containing a reducing agent for reducing the uranium (VI) into uranium (IV).

TABLE IV

| Acid organo-phosphorus compound | 0.1 to 0.125 M $1^{-1}$ phosphine oxide | Partition coefficient D U(VI) | Fe(III) | Selectivity =U(VI) Fe(III) |
|---|---|---|---|---|
| 0.5 M $1^{-1}$ di-2-ethyl-hexyl phosphoric acid | di-iso-butyl-octoxymethyl phosphine oxide (0.125 M $1^{-1}$) | 1.60 | 0.02 | 80 |
| | di-n-butyl-octoxymethyl phosphine oxide (0.125 M $1^{-1}$) | 3.00 | 0.04 | 75 |
| | di-n-pentyl-octoxymethyl phosphine oxide (0.125 M $1^{-1}$) | 4.57 | 0.05 | 91 |
| | di-n-hexyl-octoxymethyl phosphine oxide (POX11)(0.1 M $1^{-1}$) | 6.74 | 0.06 | 112 |
| | diphenyl-octoxymethyl phosphine oxide (0.125 M $1^{-1}$) | 1.48 | 0.02 | 74 |
| Ethyl-2-hexyl monoester of phenyl phosphonic acid (0.5 M $1^{-1}$) | di-n-butyl-octoxymethyl phosphine oxide (0.125 M $1^{-1}$) | 4.92 | 0.81 | 6.1 |
| | di-n-pentyl-octoxymethyl phosphine oxide (0.01 M $1^{-1}$) | 3.96 | 0.84 | 4.7 |
| | di-n-hexyl-octoxymethyl phosphine oxide (POX11)(0.1 M $1^{-1}$) | 6.24 | 0.87 | 7.2 |
| n-octyl monoester of phenyl phosphonic acid (0.5 M $1^{-1}$) | di-n-pentyl-octoxymethyl phosphine oxide (0.1 M $1^{-1}$) | 5.27 | 12.60 | 0.42 |
| | di-n-hexyl-octoxymethyl phosphine (POX11)(0.1 M $1^{-1}$) | 4.01 | 16.90 | 0.24 |
| Octyl-phenyl mono-ester of phenyl phosphonic acid (0.25 M $1^{-1}$) | di-iso-butyl-octoxymethyl phosphine oxide (0.25 M $1^{-1}$) | 1.14 | | |

EXAMPLE 3

In this example the uranium is extracted from 6 M phosphoric acid solutions having different uranium VI concentrations by means of an organic solvent containing a mixture of 0.5 M per liter of DEHP and 0.1 M per liter of POX11 diluted in dodecane.

Each extraction is carried out by bringing into contact one volume of aqueous solution with one volume of organic solvent, accompanied by stirring at a temperature of 20° C. for a period of about 15 mn. The uranium partition coefficient D is then determined. The results obtained are given in Table III.

TABLE III

| U(VI) CONCENTRATION organic phase $g.1^{-1}$ | aqueous phase $g.1^{-1}$ | $D(U^{VI})$ |
|---|---|---|
| 0.270 | 0.045 | 6.00 |
| 0.833 | 0.131 | 6.74 |
| 2.261 | 0.369 | 6.13 |
| 4.849 | 0.982 | 4.94 |

EXAMPLE 4

In this example the uranium is extracted from a 6 M phosphoric acid solution containing 1 g per liter of

EXAMPLE 5

This example relates to the treatment of 2.5 $m^3$ of phosphoric acid from sulphuric action on phosphate ores, said acid having previously undergone an oxidation treatment with 4.5 liters of hydrogen peroxide at 160 volumes in order to bring the uranium into the +6 oxidation state.

In this example 25.6 l/h of a phosphoric acid solution are introduced into the extraction unit A via line 1*a* at a temperature of 40° C., said solution containing 345 g/l of $P_2O_5$, 0.08 g/l of uranium and 1.91 g/l of iron, the uranium and iron being respectively in oxidation states +6 and +3.

Line 3*a* is also used for introducing into extraction unit A, which comprises five mixer-settler stages, 3.85 l/h of an organic solvent constituted by dodecane containing 0.5 M di-2-ethyl-hexyl phosphoric acid and 0.125 M di-n-hexyl-octoxymethyl phosphine oxide.

On leaving extraction unit A the phosphoric acid solution is discharged by line 1*b* at a flow rate of 25.6 l/h and a fraction of this flow corresponding to 0.45 l/h is transferred into the purification unit E by line 1c.

On leaving extraction unit A the uranium-charged organic solvent is discharged by line 3b and introduced into the washing unit B constituted by two mixer-settler stages in which it is brought into countercurrent contact at a temperature of 40° C. with washing water introduced at a flow rate of 0.7 l/h. The washed organic solvent, which contains 0.52 g/l of uranium and 0.16 g/l of iron is then introduced by line 3c into the first reextraction stage $C_1$.

For this reextraction, which is performed at a temperature of 40° C., the organic solvent is introduced into the first stage $C_1$ at a rate of 3.85 l/h and using line 5 a 5 M ammonia solution is also introduced into the first stage at a rate of 0.17 l/h. This makes it possible to maintain the pH of the first stage at a value of 8.5. Using line 4a a solution of ammonium carbonate with a concentration of 100 g/l is introduced into the third stage $C_3$ at a rate of 0.7 l/h, which corresponds to 74% of the quantity which is stoichiometrically necessary for neutralizing di-2-ethyl-hexyl phosphoric acid and transforming the uranium ion uranyl ammonium tricarbonate.

On leaving the third reextraction stage the organic solvent is discharged by line 3b at a rate of 4.15 l/h and its uranium concentration is 0.002 g/l. This uranium-removed solvent is then introduced at a rate of 4.15 l/h by line 3d into purification unit E, where it is brought into contact with the phosphoric acid from extraction unit A and introduced by line 1c at a flow rate of 0.45 l/h. The purified organic solvent leaves the purification unit E by line 3a at a rate of 3.85 l/h and is then recycled in extraction unit A.

In the reextraction stages and particularly in the first stage the iron is precipitated in hydroxide form and it is continuously or discontinuously removed by filtration and recycling of the solution circulating in the reextraction stages.

Thus, 0.75 kg of wet precipitate is eliminated per 2.5 $m^3$ of acid treated.

On leaving the first reextraction stage $C_1$ the aqueous solution containing a uranyl ammonium tricarbonate is discharged by line 4b at a rate of 0.57 l/h. This aqueous solution contains 3.57 g/l of uranium and is then treated in the uranium separation unit D.

In this unit the solution is firstly clarified and it is then kept at 95° C. for six hours in a reactor, accompanied by bubbling of air. After filtering, washing with water, drying at 120° C. and roasting at 400° C. 190 g of uranium in the form of uranium trioxide is obtained for every 2.5 $m^3$ of acid treated, which corresponds to an overall uranium yield of 95%.

What is claimed is:

1. A process for the recovery of the uranium (VI) present in a phosphoric acid solution by bringing the said solution into contact with an organic solvent suitable for extracting the uranium, wherein the organic solvent comprises a system of extractants constituted by an acid organophosphorus compound, selected from the group consisting of organophosphoric acids and organophosphoric acids, and by a neutral phosphine oxide of the formula:

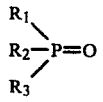

(I)

in which the radicals $R_1$, $R_2$ and $R_3$ are identical or different alkyl, aryl or alkoxy methyl radicals, at least one of the radicals $R_1$, $R_2$ and $R_3$ being an alkoxy methyl radical.

2. A process according to claim 1, wherein the acid organophosphorus compound is a dialkyl phosphoric acid of formula:

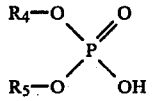

(II)

in which $R_4$ and $R_5$ are identical or different alkyl radicals.

3. A process according to claim 2, wherein the radicals $R_4$ and $R_5$ are identical or different branched alkyl radicals, having at least eight carbon atoms.

4. A process according to claim 2, wherein the dialkyl phosphoric acid is di-2-ethyl-hexyl phosphoric acid.

5. A process according to claim 1, wherein the acid organophosphorus compound is a phosphonic acid of formula:

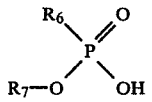

(III)

in which $R_6$ and $R_7$ are identical or different alkyl or aryl radicals.

6. A process according to claim 1, wherein the alkoxy methyl radical has 4 to 12 carbon atoms.

7. A process according to claim 6, wherein the neutral phosphine oxide is di-n-hexyl-octoxymethyl phosphine oxide.

8. A process according to claim 1, wherein in the said system of extractants the concentrations of acid organophosphorus compound and neutral phosphine oxide are such that the molar ratio of the acid organophosphorus compound to the neutral phosphine oxide is between 4 and 5.

9. A process according to claim 1, further comprising countercurrently reextracting the uranium in said organic solvent in at least two stages with an ammonium carborate solution, by introducing said organic solvent into the first stage and by countercurrently introducing the ammonium carborate solution into each stage, and in the last stage in a quantity such that it represents 50 to 80% of the stoichiometric quantity necessary for neutralizing the acid organophosphorus compound and for transforming the uranium present in the organic solvent into uranyl ammonium tricarbonate and adding ammonia in the form of a gas or an aqueous solution to the ammonium carbonate solution circulating in the first stage in order to maintain the pH of the first stage at a value between 8 and 8.5.

10. A process according to claim 9, wherein the ammonia organic solvent leaving the final reextraction stage is purified by reacting it with an acid to eliminate the ammonium in the form of ammonium salt and wherein the thus purified organic solvent is reused for carrying out uranium extraction.

11. A process according to claim, 10 wherein the acid is chosen from the group comprising sulphuric acid, hydrochloric acid and phosphoric acid.

12. A process according to claim 10, wherein the ammonia organic solvent leaving the final reextraction stage is purified by reacting it with phosphoric acid recovered at the end of uranium extraction.

* * * * *